United States Patent [19]

Blanchard et al.

[11] Patent Number: 4,615,708

[45] Date of Patent: Oct. 7, 1986

[54] METHOD FOR INSITU COLORING CROSSLINKED CELLULOSIC MATERIALS

[75] Inventors: Eugene J. Blanchard, Metairie; Joseph S. Bruno, Chalmette, both of La.

[73] Assignee: The United States of America as represented by the Secretary of Agriculture, Washington, D.C.

[21] Appl. No.: 789,298

[22] Filed: Oct. 18, 1985

[51] Int. Cl.[4] ..... C09B 67/00

[52] U.S. Cl. ..... 8/585; 8/181; 8/185; 8/186

[58] Field of Search ..... 8/181, 185, 186, 585, 8/636

[56] References Cited

U.S. PATENT DOCUMENTS

| | | | |
|---|---|---|---|
| 3,788,804 | 1/1974 | Harper et al. | 8/18 |
| 3,807,946 | 4/1974 | Harper et al. | 8/18 |
| 3,824,074 | 7/1974 | Bugaut et al. | 8/10 |
| 3,853,459 | 12/1974 | Blanchard et al. | 8/18 |
| 4,023,926 | 5/1977 | Bugaut et al. | 8/10 |

OTHER PUBLICATIONS

Morrison and Boyd, Organic Chemistry, 1959, pp. 542–543, 562–565, Allyn and Bacon, Inc.

*Primary Examiner*—Paul Lieberman
*Assistant Examiner*—Brooks Truskett
*Attorney, Agent, or Firm*—M. Howard Silverstein; David G. McConnell; Raymond C. Von Bodungen

[57] ABSTRACT

Cellulosic materials, such as cotton fabrics, can be colored insitu by first treating the fabric with N-phenyldiethanolamine and a crosslinking agent for cellulose, such as dimethylol dihydroxyethyleneurea. After the fabric has been cured it is then colored by treating with sufficient concentrations of nitrous acid to form the colored nitroso derivative of the tertiary aromatic amine. The colors obtained are shades of green and yellow which are determined by: concentration of the N-phenyldiethanolamine; type of crosslinking agent; strength of the nitrous acid, and reaction times.

14 Claims, No Drawings

METHOD FOR INSITU COLORING CROSSLINKED CELLULOSIC MATERIALS

BACKGROUND OF THE INVENTION

1. Field of the Invention

This invention relates to the coloring of cellulosic containing materials. More specifically it relates to coloring of crosslinked cellulosic fabric by insitu formation of the colored nitroso derivative of a tertiary aromatic amine.

2. Description of the Prior Art

Products such as chambray fabric, frosted pile fabric, multicolored fabric, and fabrics with shade differential can be produced by selectively crosslinking cellulose prior to dyeing. However in all these processes it is only the non-crosslinked fibers which take up the dyestuff. Some processes utilize partial crosslinking which take up dye to produce fabrics with shade differential effects. In all cases dyeing of cellulosic materials after crosslinking is not usually possible. Heretofore the deficiency of crosslinked fiber to absorb dyestuff was overcome by grafting or depositing materials with affinity for specific dyes onto cellulose. Crosslinked cotton containing basic grafts, such as triethylamine, can be dyed with acid dyes (Harper et. al. U.S. Pat. No. 3,807,946). Crosslinked cellulose containing acid grafts, such as citric acid, can be dyed with basic dyes (Harper et. al. U.S. Pat. No. 3,788,804). In addition, crosslinked cottons containing polymeric materials such as polyacrylates or polyurethanes, were dyed with disperse dyestuffs utilizing affinity of dye for polymer substrate (Blanchard et. al. U.S. Pat. No. 3,853,459).

SUMMARY OF THE INVENTION

This invention provides a method for the insitu coloring of crosslinked cellulose by formation of a colored nitroso derivative of a tertiary aromatic amine. The method involves treating cellulose containing fabric with a methylolated crosslinking agent, and a tertiary aromatic amine such as N-phenyldiethanolamine, followed by drying and curing for sufficient time at sufficient temperature to react the components with the fabric. The cured fabric is then treated with a solution of sufficient concentration of nitrous acid for sufficient time to form a colored nitroso derivative.

DESCRIPTION OF THE PREFERRED EMBODIMENTS

Crosslinked cellulose-containing fabrics can be colored by formation of nitroso derivative of a tertiary aromatic amine that is bound to the cellulose through a methylolated crosslinking agent.

The tertiary aromatic amine used is N-phenyldiethanolamine of the following structure:

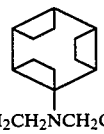

$HOCH_2CH_2NCH_2CH_2OH$

In general, coloring of treated crosslinked cellulose containing fabric is accomplished by aftertreatment with nitrous acid to form a colored nitroso derivative of n-phenyldiethanolamine. Crosslinking consists of treating the fabric with a methylolated crosslinking agent in concentrations of from about 4% to 8% for each 100% of formulation, from about 1% to 4% of a tertiary aromatic amine and an acid catalyst, such as zinc nitrate hexahydrate. After the fabric has been padded, it is dried and cured. The fabric is usually laundered to remove unreacted material prior to coloring. Nitrous acid is used to color the fabric. It is prepared by reacting equal molar concentrations of sodium nitrite and hydrochloric acid at a temperature between 0° C. and 10° C. The temperature during the coloring operation is usually from about 0° C. and 15° C. with lower temperatures preferred. Concentration of nitrous acid is usually from about 0.1% to 1% and contact time of the fabric with the nitrous acid is from 2.5 to 15 minutes. Various shades of coloring (yellow and green) can be obtained by adjusting the concentration of the tertiary aromatic amine used in the pretreatment formulation as well as the concentration of nitrous acid in the coloring formulation. Depth of shades is controlled by varying the higher concentrations of nitrous acid and reaction time.

Light yellow color is obtained by treating a crosslinked fabric with a relatively low concentration of nitrous acid for a relatively short reaction time. As the concentration of nitrous acid is increased coloration progressively increases. When concentration of nitrous acid and reaction time are increased sufficiently there occurs a change in color from yellow to green. Maximum depth of color is obtained by reacting 1% nitrous acid from about 10 to 15 minutes with the crosslinked fabric. Shade of color of crosslinked fabric can be controlled by quenching the reaction with water once desired visible results are observed. In addition, color can also be reintensified or altered for depth of shade by retreating the colored fabric with the nitrous acid solution at later dates.

The utility of this method is described but not limited to the following examples:

EXAMPLE 1

An aqueous solution was prepared using 4% dimethylol dihydroxyethyleneurea, 4% N-phenyldiethanolamine, and 0.3% zinc nitrate hexahydrate. A desized, scoured, and bleached sample of cotton sheeting was padded with the formulation to 90% wet pickup. The fabric was dried at 60° C. for 3 minutes and then rinsed in water and again dried. The fabric was placed in a 0.1% aqueous solution of nitrous acid at 6°–8° C. for 2.5 minutes to obtain a light yellow color. It was then rinsed with water to remove excess nitrous acid and again dried.

EXAMPLE 2

Cotton sheeting was treated as in Example 1 except that the crosslinked fabric was treated with nitrous acid solution for 15 minutes at 10°–15° C. and then rinsed and dried. This fabric resulted in a light green coloring. This example shows the effect on color depth by varying the time of the fabric in the nitrous acid solution.

EXAMPLE 3

Cotton fabric was treated as in Example 2 except the crosslinked fabric was treated with a 0.5% aqueous solution of nitrous acid. After rinsing and drying the fabric produced had a yellowish-green color. This example demonstrates the effect of varying the concentration of the nitrous acid solution on the color depth of fabric produced.

EXAMPLE 4

Cotton fabric was treated as in Example 2 except the crosslinked fabric was treated with a 1% aqueous solution of nitrous acid for 5 minutes at 10°–15° C. The fabric produced had a yellowish-green coloration and was not colored as deeply as the sample of Example 3. This shows that the shade of the fabric can be altered by adjusting the concentration of the nitrous acid solution and the reacton time in the bath.

EXAMPLE 5

A 100% cotton sheeting fabric was treated as in Example 1 except the padding solution was composed of 4% N-phenyldiethanolamine, 8% dimethylol dihydroxyethyleneurea, 0.5% zinc nitrate hexahydrate and the remainder water. After drying and curing as in Example 1 the fabric was colored by treating with a 1% aqueous solution of nitrous acid at 6°–8° C. for 15 minutes. This produced a green colored fabric which was then rinsed and dried. This example shows varying concentrations of padding solution does effect fabric coloration produced by formation of the colored nitroso derivitive.

EXAMPLE 6

The fabric was treated as in Example 5 except that the sample was treated with the nitrous acid solution for 2.5 minutes. The color of this sample was greenish-yellow. This shows that varying the time in the nitrous acid solution results in a different shade fabric.

EXAMPLE 7

The fabric was treated as in Example 5 except the sample was treated with a 0.1% aqueous solution of nitrous acid for 2.5 minutes. The color of the fabric produced was yellow. This shows that a different colored fabric can be produced by varying the concentration of the nitrous acid solution.

EXAMPLE 8

The fabric was treated as in Example 5 except that the padding solution contained 1% N-phenyldiethanolamine instead of 4% of the compound. After treating with nitrous acid, rinsing in water, and drying, the color of the fabric produced was greenish-yellow. This shows that by varying the concentration of the tertiary aromatic amine lighter shades of colored fabric can be obtained.

EXAMPLE 9

The fabric was treated as in Example 8 except that the fabric was dyed by treating with the nitrous acid solution for 2.5 minutes. The color of the fabric produced was yellow. This shows that varying the amount of time the sample is in the nitrous acid solution alters the coloration of the fabric.

We claim:

1. A process for coloring cellulose containing fabric comprising:

(a) padding a cellulose containing fabric with a solution of sufficient concentrations of: methylolated crosslinking agent, an effective amount of N-phenyl tertiary amine containing sufficient hydroxy functionality to form a colored nitroso derivative of said N-phenyl tertiary amine, and an acid catalyst to impart smooth-dry properties to said fabric;

(b) drying and curing said fabric for sufficient time and temperature to interact the componments of the solution with the fabric;

(c) immersing the fabric in a solution of sufficient concentration of nitrous acid for sufficient time to color said fabric.

2. The process of claim 1 wherein the cellulose containing fabric is cotton.

3. The process of claim 1 wherein the methylolated crosslinking agent is selected from the group consisting of: dimethyloldihydroxyethyleneurea, dimethylolethyleneurea and dimethylolpropylcarbamate.

4. The process of claim 1 wherein the tertiary N-phenyl amine is N-phenyldiethanolamine.

5. The process of claim 1 wherein the acid catalyst is selected from the group consisting of: zinc nitrate hexahydrate, magnesium chloride hexahydrate, para-toluenesulfonic acid and citric acid.

6. The process of claim 1 wherein the fabric is dried at from about 60° to 160° C. for from about 5 to 3 minutes and cured at from about 140° C. to 180° C. for from about 5 to 1.5 minutes.

7. The process of claim 1 wherein the concentration of nitrous acid solution is from about 0.1 to 1% and the immersion time is from about 2.5 to 15 minutes.

8. The process of claim 1 wherein the crosslinking agent in the padding solution is used in concentrations of from about 4 to 10%.

9. The process of claim 1 wherein the color of fabric can be varied by varying the concentration of the tertiary N-phenyl amine from about 1 to 4%.

10. The process of claim 1 wherein the acid catalyst is used in a padding solution in concentrations of from about 0.2 to 3%.

11. A colored cellulose containing fabric produced in accordance with the process of claim 1.

12. A colored cotton fabric produced in accordance with the process of claim 2.

13. A colored cellulose containing smooth-dry fabric characterized by a colored nitroso derivative of a N-phenyl tertiary amine crosslinked on said fabric through hydroxy functionality present on said tertiary N-phenyl amine.

14. The product of claim 13 wherein the cellulose containing fabric is cotton.

* * * * *

UNITED STATES PATENT AND TRADEMARK OFFICE

CERTIFICATE OF CORRECTION

PATENT NO. : 4,615,708

DATED : October 7, 1986

INVENTOR(S) : Eugene J. Blanchard and Joseph S. Bruno

It is certified that error appears in the above—identified patent and that said Letters Patent is hereby corrected as shown below:

Column 2, line 46, after dried insert --and cured--; after 60°C. insert --and 160°C.--; after for insert--5 minutes and--; after 3 minutes insert --, respectively,--.

Signed and Sealed this

Seventeenth Day of February, 1987

*Attest:*

DONALD J. QUIGG

*Attesting Officer*

*Commissioner of Patents and Trademarks*